US006561837B1

(12) United States Patent
Ishida

(10) Patent No.: US 6,561,837 B1
(45) Date of Patent: May 13, 2003

(54) INSULATION DISPLACEMENT CONNECTOR

(75) Inventor: Junko Ishida, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/677,770

(22) Filed: Oct. 3, 2000

(30) Foreign Application Priority Data

Oct. 4, 1999 (JP) ..... 11-283194

(51) Int. Cl.[7] ..... H01R 4/24
(52) U.S. Cl. ..... 439/397; 439/733.1
(58) Field of Search ..... 439/595, 397, 439/733.1, 398, 400, 406

(56) References Cited

U.S. PATENT DOCUMENTS 4,557,543 A * 12/1985 McCleerey et al. ..... 439/408
4,820,179 A * 4/1989 Saijo ..... 439/224
5,380,220 A * 1/1995 Okabe ..... 439/456
5,749,752 A * 5/1998 Kashiyama et al. ..... 439/733.1
5,934,927 A * 8/1999 Nagai ..... 439/397
6,007,365 A * 12/1999 Atsumi et al. ..... 439/397
6,106,339 A * 8/2000 Nagai ..... 439/748
6,106,340 A * 8/2000 Myer et al. ..... 439/752
6,299,471 B1 * 10/2001 Hatagishi et al. ..... 439/397

FOREIGN PATENT DOCUMENTS

JP 09-161878 12/1995
JP 10-040973 7/1996

* cited by examiner

*Primary Examiner*—Renee Luebke
*Assistant Examiner*—L. Tsukerman
(74) *Attorney, Agent, or Firm*—Finnegan, Henderson, Farabow, Garrett & Dunner, L.L.P.

(57) ABSTRACT

There is provided an insulation displacing terminal having a first engagement part, a housing which has a side wall defining a groove for accommodating the insulation displacing terminal. The side wall has a second engagement part engaging with the first engagement part for locking. The first engagement part is an opening part, and the second engagement part is a projection.

6 Claims, 4 Drawing Sheets

INSULATION DISPLACEMENT CONNECTOR

BACKGROUND OF THE INVENTION

1. Field of the Invention

The present invention relates to an insulation displacement connector, and, more particularly, to an insulation displacement connector to be adapted to a vehicle, such as an automobile.

2. Description of Relevant Art

There is disclosed an insulation displacement connector in Japanese Patent Application Laid-Open Publication No.10-40973. The connector is constituted to accommodate insulation displacing terminals in a housing. Each of the terminals includes a contact part for a mating terminal to be inserted and fitted in, and a wire connecting part for connecting with and holding an end of an insulated wire. The housing has groove parts formed parallel to each other, the groove parts being configured to accommodate insulation displacing terminals. Front ends of the groove parts are covered with a top board and inner spaces accommodate contact parts of the terminals. The top board is formed with engagement holes to be engaged and locked with lances which are formed on upper parts of the contact parts of the terminals. Wire connecting parts on rear ends of the terminals are formed with displacing blades facing each other, the blades projecting inward from opposing side plates of wire connecting parts. Rear ends of the blades are formed with holding pieces for holding insulated wires.

SUMMARY OF THE INVENTION

In the above-described insulation displacement connector, the insulation displacement terminals which are accommodated in groove parts of a housing are supported in such way that the lances are latched with the engagement holes of the top board. In such connector, if, for example, movement in a production process of a harness or arrangement of the insulated wires makes a pulling-out force applied to the insulated wires, the lances of terminals are easily detached from engagement holes of a housing, thus causing the terminals to be easily pulled out of the housing. If a tension in a pulling-out direction is applied to insulated wires, holding pieces are simply bent to hold the insulated wires, thus causing holding force to be easily weakened. When the holding force of the holding pieces weakening, tensile-stress to insulated wires concentrates on the blades. The blades are formed in such way that side plates are cut and bent, and they are easy to be bent in a direction of pulling the insulated wires, thus not sufficiently holding the insulated wires.

An object of the invention is to provide an insulation displacement connector in which an insulation displacing terminal is difficult to be detached from a housing and an insulated wire is difficult to be pulled out of an insulation displacing terminal.

From an aspect of the present invention, there is provided an insulation displacement connector as follows. The connector includes an insulation displacing terminal having a first engagement part; a housing which has a side wall defining a groove for accommodating the insulation displacing terminal. The side wall has a second engagement part engaging with the first engagement part for locking.

Preferably, the first engagement part is an opening part, and the second engagement part is a projection.

Preferably, the insulation displacing terminal has a basis plate and a side plate extending form the basis plate. The side plate defines the opening part engaging with the projection for locking.

Preferably, the insulation displacing terminal has an insulation displacing plate at an edge of the opening part. The insulation displacing part extends away from the side wall.

Preferably, an insulated wire is pressed to the insulation displacing plates located adjacent openings in the side plates, and the opening parts engage with the projections for locking.

According to the invention, the second engagement part of the side wall engages with the first engagement part of the insulation displacing terminal, and the insulation displacing terminal is locked with the housing.

When assembling the insulation displacing terminal to the groove of the housing, the side plate of the terminal is away from the projection of the side wall, and the terminal is easily inserted in the groove.

BRIEF DESCRIPTION OF THE ACCOMPANYING DRAWINGS

Figure 3A:
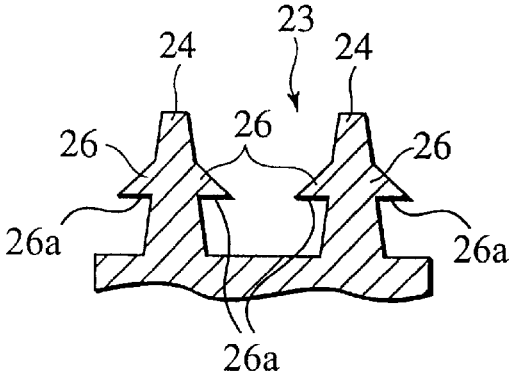
Figure 3B:
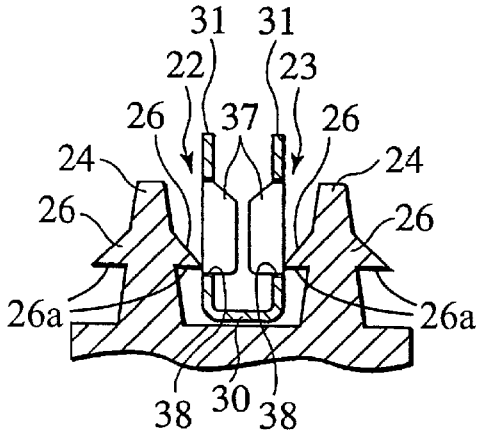
Figure 3C:
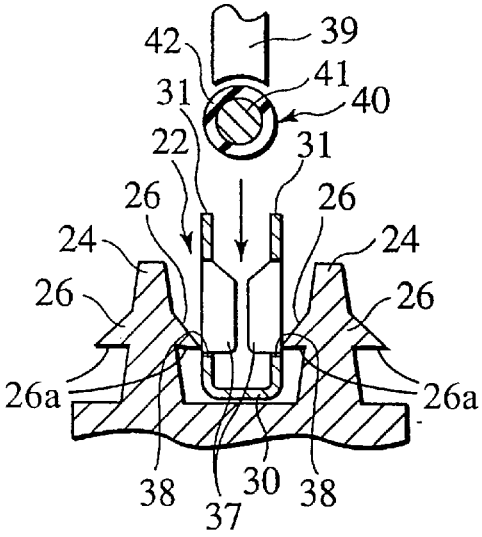
Figure 3D:
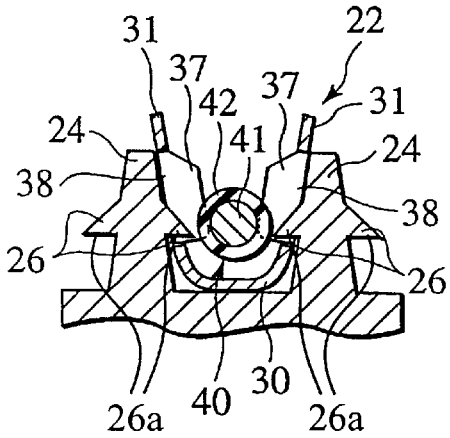
Figure 4:
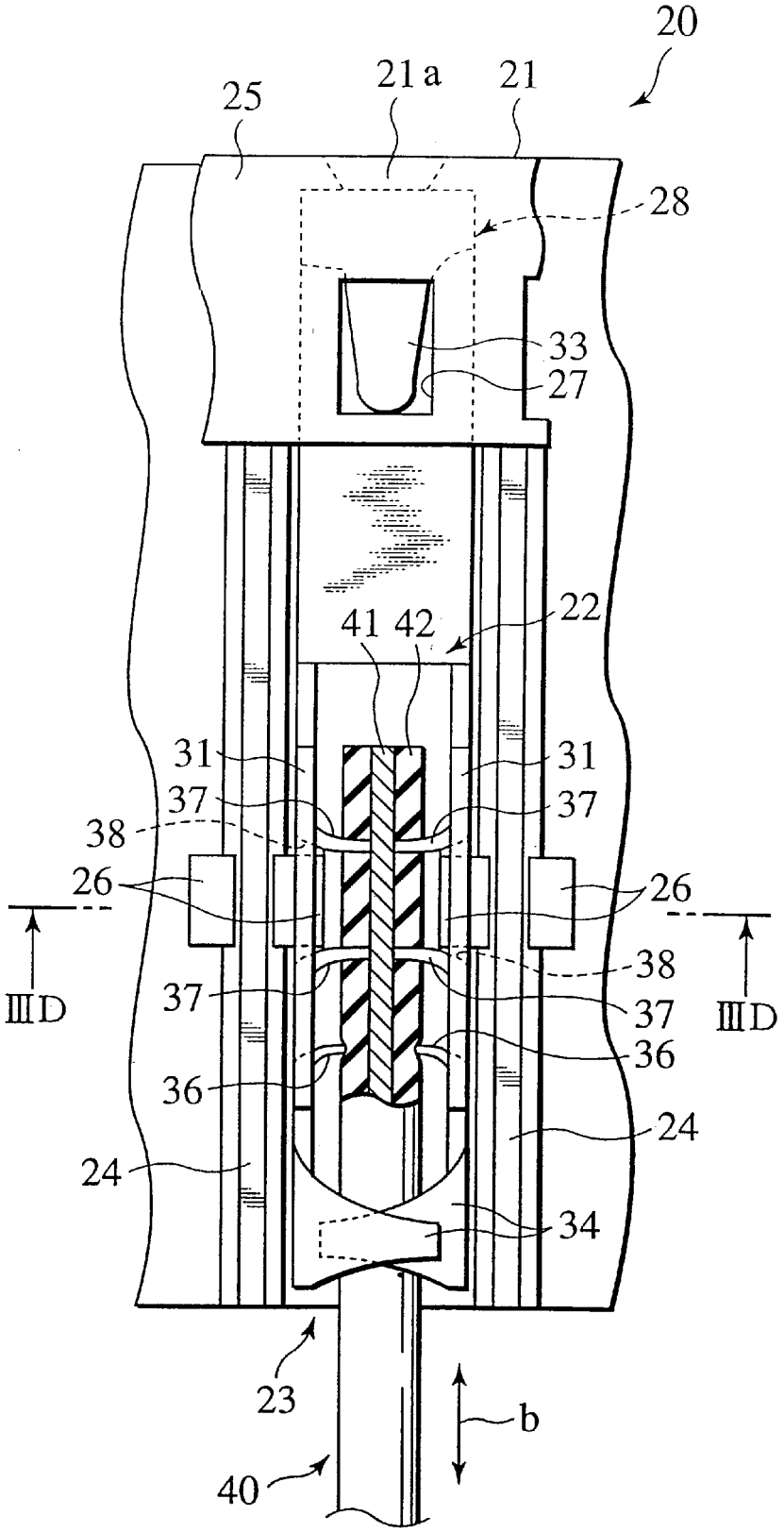

FIGS. 3A, 3B, 3C, and 3D are sectional explanation views which show processes in which an insulation displacing terminal and an insulated wire are attached to a housing of an insulation displacement connector, and FIG. 3D is taken on line IIID—IIID of FIG. 4; and FIG. 4 is a plane view of main part of an embodiment.

DETAILED DESCRIPTION OF THE PREFERRED EMBODIMENTS

Embodiments of the present invention will hereby be explained with reference to the drawings.

Figure 1:
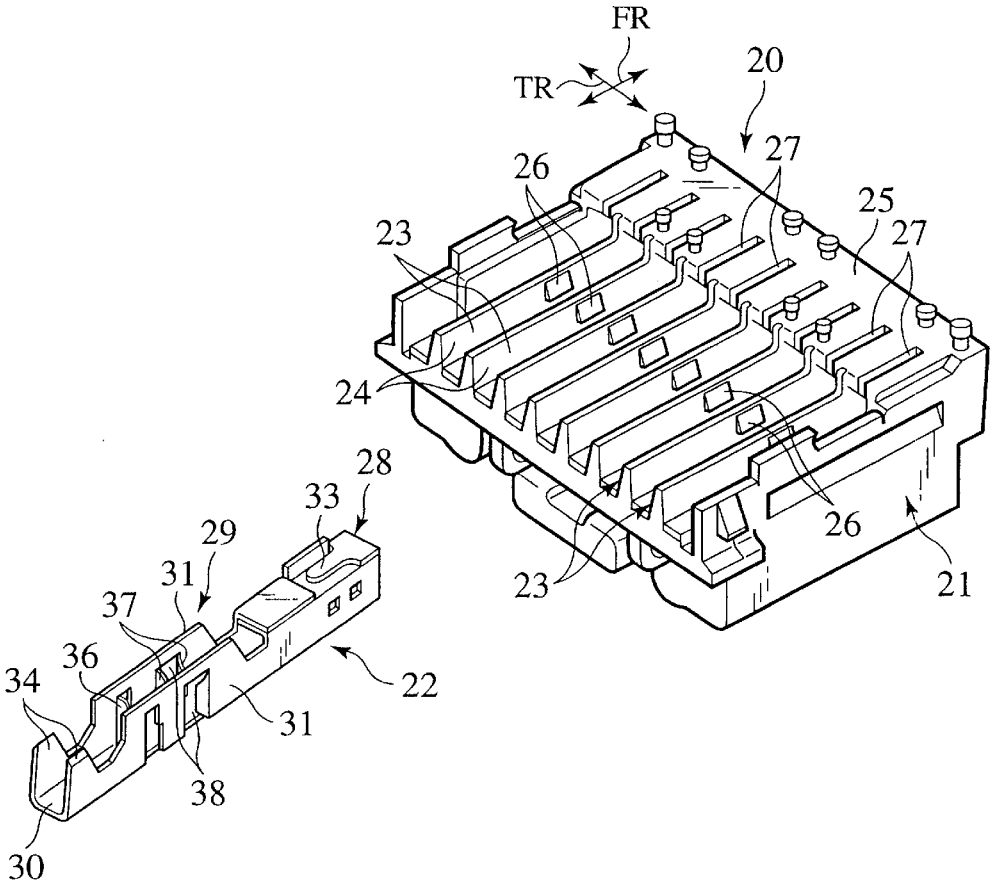
FIG. 1 is an exploded perspective view of an insulation displacement connector of an embodiment according to the invention, in which FR is a front and rear direction and TR is a transverse direction of the connector.

As shown on FIG. 1, an insulation displacement connector 20 includes a housing 21 and an insulation displacing terminal 22.

The housing 21 is formed of terminal accommodating groove parts 23 from front to rear thereof positioned parallel each other. The groove parts 23 have side walls 24 formed on both sides thereof. Groove parts 23 adjacent to each other are formed with side walls 24 therebetween. A top board 25 which covers upper parts of the groove parts 23 is formed integrally at a front end of the housing 21. In each of the groove parts 23 covered with the top board 25, a front end of an insulation displacing terminal 22 is to be accommodated. A front side of the housing 21 has openings 21*a* formed as shown on FIG. 4, and through each of them a mating terminal is inserted and fitted in the front end part of the terminal 22.

Intermediate parts on the side walls 24 of the housing 21 have engagement projections 26 toward insides of the groove parts 23. Both side walls 24 between which each of the groove parts 23 is interposed are formed of engagement projections 26 facing each other at their positions opposing to each other. The top board 25 of the housing 21 has lance engagement holes 27 each formed at a position corresponding to a groove part 23.

Figure 2:
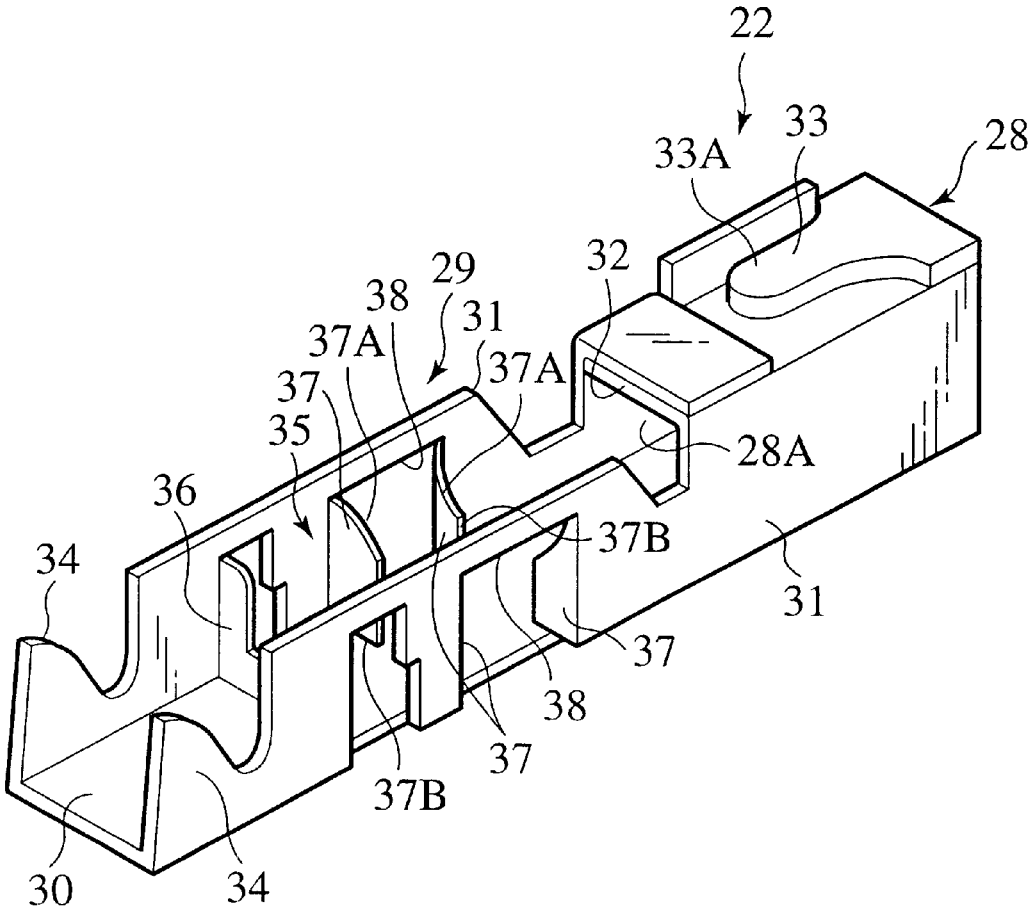
FIG. 2 is a perspective view of an insulation displacing terminal of an embodiment.

The terminal 22, on FIG. 2, has a contact part 28 with a mating terminal which is formed at a front end thereof and a wire connecting part 29 formed at a rear side thereof. The terminal 22 is manufactured in such way that a sheet of metal plate is stamped out from a metal plate galvanized on both sides thereof to be formed in a predetermined exploded shape, and thus to be bent.

The contact part 28 and the wire connecting part 29 are formed along a common basis plate 30. Both edges in a transverse direction of the basis plate 30 have a pair of side plates 31 which stand at a right angle relative to the basis plate 30. The side plates 31 are opposed and in parallel to each other.

The contact part 28 has a cover plate 32 which extends from an upper edge of one side plate 31 and is manufactured by bending. In a space 28A defined by the cover plate 32 and the side plates 31, a mating terminal is to be inserted and fitted, so that the mating terminal and the terminal 22 are electrically connected together. The other side plate 31, as shown on FIG. 2, has a lance 33 integrally formed on an upper edge thereof. The lance 33 is bent and stacked on the cover plate 32 in such way that a distal end 33A rises slightly from the cover plate 32.

The wire connecting part 29 has a pair of wire holding pieces 34 formed at a rear end thereof. At a front side of the wire holding pieces 34 in the wire connecting part 29, there is provided an insulation displacing part 35. The insulation displacing part 35 has a pair of wire holding plates 36 formed in such way that the side plates 31 have been cut and bent inward, and two pairs of insulation displacing plates 37 formed in such way that front side plates 31 relative to the wire holding plates 36 are cut and bent inward. The two pairs of displacing plates 37 are formed in such way that two displacing plates 37 positioned on the side plate 31 are bent in different directions from each other as wide opened doors. As a result, a side plate 31 has an opening part 38 formed between both displacing plates 37. The opening part 38 is to be fitted in an engagement projection 26 positioned on a side wall 24 of the housing 21.

A displacing plate 37 has a declined slope 37A formed at upper parts thereof for guiding an insulated wire. The declined slope 37A is a bevel formed in such way that a side plate 31 is cut. The displacing plate 37 has an insulation displacing edge 37B formed at an end thereof for displacing an insulation coating of an insulated wire and contacting with a core wire of the wire.

Next, with respect to an insulation displacement connector 20 of the embodiment, a method for attaching a housing 21 to an insulation displacing terminal 22 and functions are explained in accordance with FIGS. 3A, 3B, 3C, 3D and 4.

FIG. 3A is a sectional view of a part formed with engagement projections 26 defining ledge portions 26*a* in a terminal accommodating groove part 23 of a housing 21. When the groove part 23 accommodates the terminal 22, a contact part 28 of the terminal 22 is inserted from a rear side of the terminal 22, and the contact part 28 is inserted to be placed under a top board 25. Furthermore, the lance 33 slides on a lower side of the top board 25, being pressed downward, the lance being formed on an upper part of the contact part 28 and slightly rising at a rear end thereof. When being completely accommodated in an engagement hole 27, the lance 33 rises again and engages with the engagement hole 27 for locking. According to this, the terminal 22, being held in groove part 23, is supported by the housing 21. This state, as in FIG. 3B, shows that opening parts 38 and engagement projections 26 are not fitted, but face each other, the opening part 38 being formed in both side plates 31, the projections 26 being located at an intermediate height on side walls 24.

Next, as shown on FIG. 3C, an end of an insulated wire 40 is press fitted in a wire connecting part 29, using a press-fitting jig 39. The insulated wire 40 is press fitted along between: two pairs of insulation displacing plates 37, a pair of wire holding plate 36, and a pair of wire holding pieces 34. Upper parts of the displacing plate 37 and the holding plate 36, as shown on FIG. 2, are each formed with a guide slope declining toward an inside of a groove, and the insulated wire 40 is easily guided toward a central portion. Relative to the insulated wire 40 which is press fitted between two pairs of displacing plates 37, edges 37B of the displacing plates 37 cut an insulation coating 42, thereby core wire 41 electrically contacts with the displacing plates 37. Press fitting the insulated wire 40 between opposed displacing plates 37 make the displacing plates 37 bent away from each other. As shown on FIG. 3D, side plates 31 are spaced from each other and contact with both of the side walls 24. At this step, the opening parts 38 and engagement projections 26 are fitted with each other, and the projections 26 is inserted in the opening parts 38, the opening parts being formed in both side walls 31 of the terminal 22, the projections being provided on the side walls 31.

With the projections 26 being inserted in the opening parts 38, the terminal 22 is prevented from moving in a groove part 23 in a front and rear direction. Before the projections 26 are inserted in the opening parts 38, the lance 33 engages for locking with the engagement hole 27, so that the terminal 22 is restrained from moving in a front and rear direction. The projections 26 inserted in the opening parts 38 make the strength for restraining a movement in a front and rear direction improved and, in addition, by virtue of ledge portions 26*a,* restrain the terminal 22 from moving upward from groove part 23. Therefore, the terminal 22 is prevented from being loosened as well as being detached.

The projected 26 inserted in the opening parts 38 objects inside the side plates 31 of the terminal 22, and have a function for reinforcing sides of the displacing plates 37. Therefore, as shown in FIG. 4, if a load in an axis direction b is applied to the insulated wire 40, there is a function to prevent the displacing plates 37 from bending in the front and rear direction. If a forward load of the terminal 22 is applied to the insulated wire 40, the projections 26 have a function to prevent the displacing plates 37 at a rear side of the side plates 31 from falling down forward. On the other hand, if a load for pulling rearward of the terminal 22 is applied to the insulated wire 40, the projections 26 has a function to prevent the displacing plates 37 at a front side of the side plates 31 from falling down rearward. If a force for moving the insulated wire 40 in a front or rear direction relative to the terminal 22 is applied to the insulated wire 40, the projections 26 reinforce one of front and rear displacing plates 37 to be prevented from being fallen down, so that a relative positional relationship between the other side plate 37 and the insulated wire 40 does not change, thus to prevent falling down.

As above described, although the embodiment has been explained, the invention is not limited to this, and modifications and variations of the embodiment which accompany with the points of constitution can occur. For example, though the embodiment has two pairs of insulation displacing plates 37, with a constitution having at least one pair of insulation displacing plates, preferable electrically connecting are performed. Though the embodiment has wire holding pieces 36, they may be omitted.

Though the embodiment is constituted in such way that an engagement projection 26 on a side wall 24 is fitted in an opening part 38 formed in a side plate 31 of an insulation displacing terminal 22, a recessed part may be formed to the side plate 31 to be fitted to an engagement projection 26.

What is claimed is:

1. An insulation displacement connector comprising:

an insulation displacing terminal having first engagement parts;

a housing having side walls defining a groove for accommodating the insulation displacing terminal, the side walls having a pair of opposed second engagement parts engaging with the first engagement parts, wherein the second engagement parts include a ledge structure located intermediate a height of the side walls, the ledge structure positively engaging the first engagement parts for preventing displacement of insulation displacing terminal in an upward direction with respect to a longitudinal extent of the groove once installed, wherein the first engagement parts are opening parts.

2. The insulation displacement connector of claim 1, wherein the ledge structure comprises a wall extending obliquely downward from a side wall.

3. The insulation displacement connector according to claim 1, wherein the insulation displacing terminal has a base plate and side plates extending from the base plate, and wherein the side plates define the opening parts.

4. The insulation displacement connector according to claim 3, wherein the insulation displacing terminal has insulation displacing plates at an edge of the opening parts, the insulation displacing plates extending away from the side walls.

5. The insulation displacement connector according to claim 4, wherein an insulated wire is pressed to the insulation displacing plates, and wherein the opening parts engage with the projections for locking.

6. The insulation displacement connector according to claim 5, wherein the housing further comprises a top board located between the side walls, the top board covering the groove and defining a hole therethrough, and wherein the insulation displacing terminal further comprises a top plate located between the side plates and opposite the base plate, wherein the top plate faces the top board and includes a lance projecting therefrom, the lance being locked with the hole.

* * * * *

UNITED STATES PATENT AND TRADEMARK OFFICE

CERTIFICATE OF CORRECTION

PATENT NO. : 6,561,837 B1
DATED : May 13, 2003
INVENTOR(S) : Junko Ishida

It is certified that error appears in the above-identified patent and that said Letters Patent is hereby corrected as shown below:

Column 5,
Line 14, "of insulation" should read -- of the insulation --.

Signed and Sealed this

Eleventh Day of November, 2003

JAMES E. ROGAN
*Director of the United States Patent and Trademark Office*